US006118388A

United States Patent [19]

Morrison

[11] Patent Number: 6,118,388

[45] Date of Patent: Sep. 12, 2000

[54] PORTABLE TRAFFIC LIGHT ASSEMBLY

[76] Inventor: William Morrison, 199 Dawson Ct., Westland, Mich. 48186

[21] Appl. No.: 09/107,992

[22] Filed: Jun. 30, 1998

[51] Int. Cl.[7] ..... G08G 1/095

[52] U.S. Cl. ..... 340/908; 340/907

[58] Field of Search ..... 340/907, 908, 340/924, 931, 906; 116/63 P; 40/612

[56] References Cited

U.S. PATENT DOCUMENTS

| | | | |
|---|---|---|---|
| 2,401,940 | 6/1946 | Lange | 177/337 |
| 2,829,362 | 4/1958 | Terrill | 340/908 |
| 3,206,744 | 9/1965 | Nelson | 340/908 |
| 4,032,883 | 6/1977 | Gibson | 340/908 |
| 4,162,477 | 7/1979 | Munkberg | 340/906 |
| 4,535,331 | 8/1985 | Koenig | 340/908 |
| 4,706,087 | 11/1987 | Holznagel | 340/908 |
| 4,775,865 | 10/1988 | Smith et al. | 340/906 |
| 4,777,751 | 10/1988 | Pasquale | 340/908 |
| 4,857,921 | 8/1989 | McBride et al. | 340/908 |
| 4,992,788 | 2/1991 | Arndt | 340/908 |
| 5,001,475 | 3/1991 | Scovin | 340/908 |
| 5,294,138 | 3/1994 | Yang | 340/908 |
| 5,400,019 | 3/1995 | Riscoe, Jr. | 340/908 |
| 5,805,081 | 9/1998 | Fikacek | 340/908 |

*Primary Examiner*—Brent A. Swarthout
*Attorney, Agent, or Firm*—Kenneth L. Tole

[57] ABSTRACT

A portable traffic light assembly includes a substantially rectangular base component having planar upper and lower surfaces and four side walls therebetween. A plurality of wheels are disposed on the lower surface for rolling the device from one location to another. Extending from the top surface of the base component is a telescoping support leg operable with a hydraulic pump to selectively move the leg between an extended and a retracted position. Secured to the upper distal end of the support leg is a traffic light unit having four side walls with a green, yellow and red light on each side wall thereof. The hydraulic lift pump and signal lights may be selectively operated with a remote control means allowing a user to temporarily direct traffic from a location safely distanced from oncoming traffic.

1 Claim, 3 Drawing Sheets

PORTABLE TRAFFIC LIGHT ASSEMBLY

BACKGROUND OF THE INVENTION

The present invention relates to a portable traffic light assembly that provides a temporary means for directing traffic during power outages or special events.

DESCRIPTION OF THE PRIOR ART

Traffic lights are typically installed at busy intersections to direct traffic flow in an orderly fashion. During storms or if a light pole is struck by a vehicle, electrical power may be interrupted for extended durations. During such time, the traffic signal is inoperable resulting in a chaotic and often dangerous traffic situation. Also, there is often a need to temporarily direct vehicles during special events held in areas that otherwise do not experience sufficient traffic to justify a permanent signal light.

Although portable traffic light assemblies exist in the prior art, the devices are operable with an automatic control circuit or a manual switch. The manual switch is usually located on the light assembly requiring the switch operator to be proximal oncoming traffic. Accordingly, there is currently a need for a portable, remotely operable traffic light assembly that can temporarily direct traffic during special events or emergencies.

Various portable traffic signal devices exist in the prior art. For example, U.S. Pat. No. 5,400,019 issued to Riscoe, Jr. discloses a portable traffic light including an adjustable tripod stand with a traffic light assembly secured thereto. The traffic lights are controlled with a control circuit including a programmable timer.

U.S. Pat. No. 5,001,475 issued to Scovin discloses a portable traffic control device including an upright human shaped figure with electrical back to back traffic signal units thereon. The signals are controlled by an automatic controller.

U.S. Pat. No. 4,992,788 issued to Arndt discloses a traffic control system including a trailer having a base supported by an axle and wheels and two signal supports which are extendable with a hydraulic cylinder.

U.S. Pat. No. 4,777,751 issued to Pasquale discloses a portable illuminated signal station including a platform on which a person can stand and a frame section attached thereto. Signs, lights and reflectors are supportable on the second frame.

U.S. Pat. No. 4,706,087 issued to Holznagel discloses a portable traffic signal including a base for mounting on the bed of a transporting vehicle and an articulated frame pivotally attached to the base that supports a traffic light.

U.S. Pat. No. 2,401,940 issued to Lange discloses a portable traffic signal including a base member having a telescoping extension member with a traffic signal unit thereon.

The conventional, portable traffic light assemblies such as those described above each are operated automatically or manually. It is often desirable to manually operate a traffic light to have greater control of the traffic flow. However, manual control of the lights is achieved with a switch or similar means disposed on the traffic signal assembly. Accordingly, the operator must be proximal the light assembly and thus oncoming traffic increasing the risk that the operator will be struck by a vehicle. The present invention provides a portable traffic light assembly that may be extended, retracted and operated with a remote control means. Accordingly, a user may illuminate a select light as well as the height of the traffic light housing from a remote location that is not in the path of oncoming traffic. Furthermore, the traffic signal unit according to the present invention provides a set of lights on each of four sides allowing a user to direct traffic traveling in four different directions.

SUMMARY OF THE INVENTION

The present invention relates to a portable traffic light assembly comprising a substantially rectangular base component having planar upper and lower surfaces with four side walls therebetween. Extending from the lower surface of the base component are a plurality of wheels to assist in transporting the device from one location to another. On each side wall of the base component are remote sensors for receiving a signal from a remote control means to operate the device from a remote location. Telescopically extending from the upper surface of the base component is a hydraulic support leg having a box shaped traffic light housing secured thereto. The housing likewise has planar upper and lower surfaces and four side walls therebetween. On each side wall of the traffic light housing is a green, yellow and red light means similar to those found on conventional traffic light assemblies. Received within the base component is a hydraulic pump that raises and lowers the hydraulic support leg upon receiving a signal from the control means. An internal control circuit is also selectively responsive to the hand held remote allowing a user to control the individual light means via the sensors from a remote location. It is therefore an object of the present invention to provide a portable traffic light assembly which may be operated from a remote location.

It is yet another object of the present invention to provide a portable traffic light assembly that provides a safe and convenient means for directing traffic during power outages.

It is yet another object of the present invention to provide a portable traffic light assembly which may be raised and lowered from a remote location. Other objects, features and advantages of the present invention will become readily apparent from the following detailed description of the preferred embodiment when considered with the attached drawings and the appended claims.

DESCRIPTION OF THE PREFERRED EMBODIMENT

Figure 2:
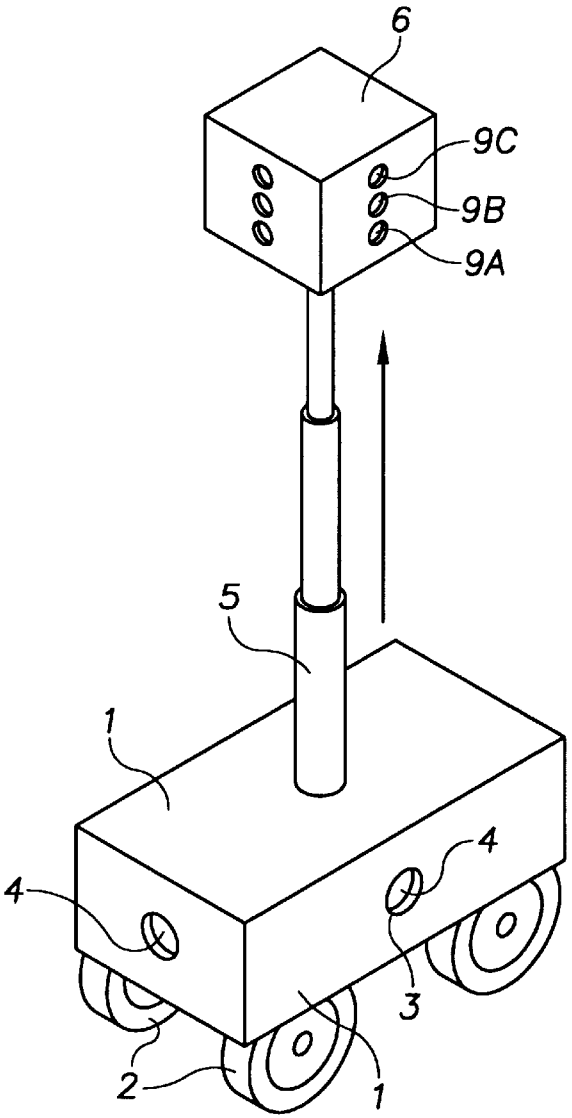
FIG. 2 depicts the inventive device in a fully extended position.
Figure 1:
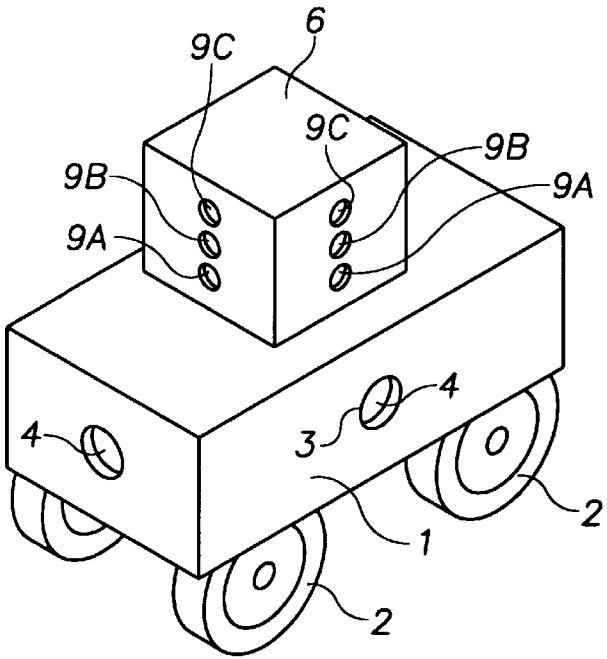
FIG. 1 depicts the inventive device in a fully collapsed position.

Referring now to FIGS. 1 through 4, the present invention relates to a portable traffic light assembly operable with a remote control means. The device comprises a base component 1 having planar upper and lower horizontal surfaces with four vertical side walls therebetween. Depending from the lower surface are a plurality of wheels 2 to assist a user in transporting the device from one location to another. Each side wall of the base component has an aperture 3 thereon preferably with a transparent cover received therein. Received within the base component are a plurality of photoelectric sensors 4 each adjacent an aperture for delivering a signal received from a remote transmitter means to internal control circuitry as will be described in more detail below. By placing a sensor on each side wall, the internal circuitry may be activated from various remote positions relative to the base component.

Extending from the top surface of the base component is a telescoping support leg 5 having a traffic light unit attached to its upper distal end. The telescopingly leg may relate to a conventional hydraulic cylinder. The support leg is movable between an extended and retracted position allowing a user to selectively position the traffic light assembly at a desired height. A hydraulic pump 7 is received within the base component and is in mechanical communication with the leg for extending it between its collapsed and extended positions upon receiving a discrete signal from the remote control means. The telescoping leg and hydraulic pump are conventional and are therefore not described nor depicted in detail.

The traffic signal unit includes a box-shaped housing 6 having planar upper and lower surfaces and four side walls therebetween. The lower surface of the housing is secured to the upper distal end of the telescoping support leg. Each side wall has three vertically aligned light means 9 thereon, preferably, a green 9A, yellow 9B and red light 9C for simulating a standard traffic signal assembly. By placing a set of lights on each side of the housing, traffic may be effectively controlled at a four way intersection.

Also received within the base component are a pair of battery means 10, 11. A first battery means 10 operates the hydraulic lift pump while a second battery means 11 operates the traffic lights described above. The lights may be automatically controlled with conventional control electronics 12 similar to that of conventional traffic light assemblies to illuminate the green, yellow or red lights for a predetermined duration.

Figure 3:
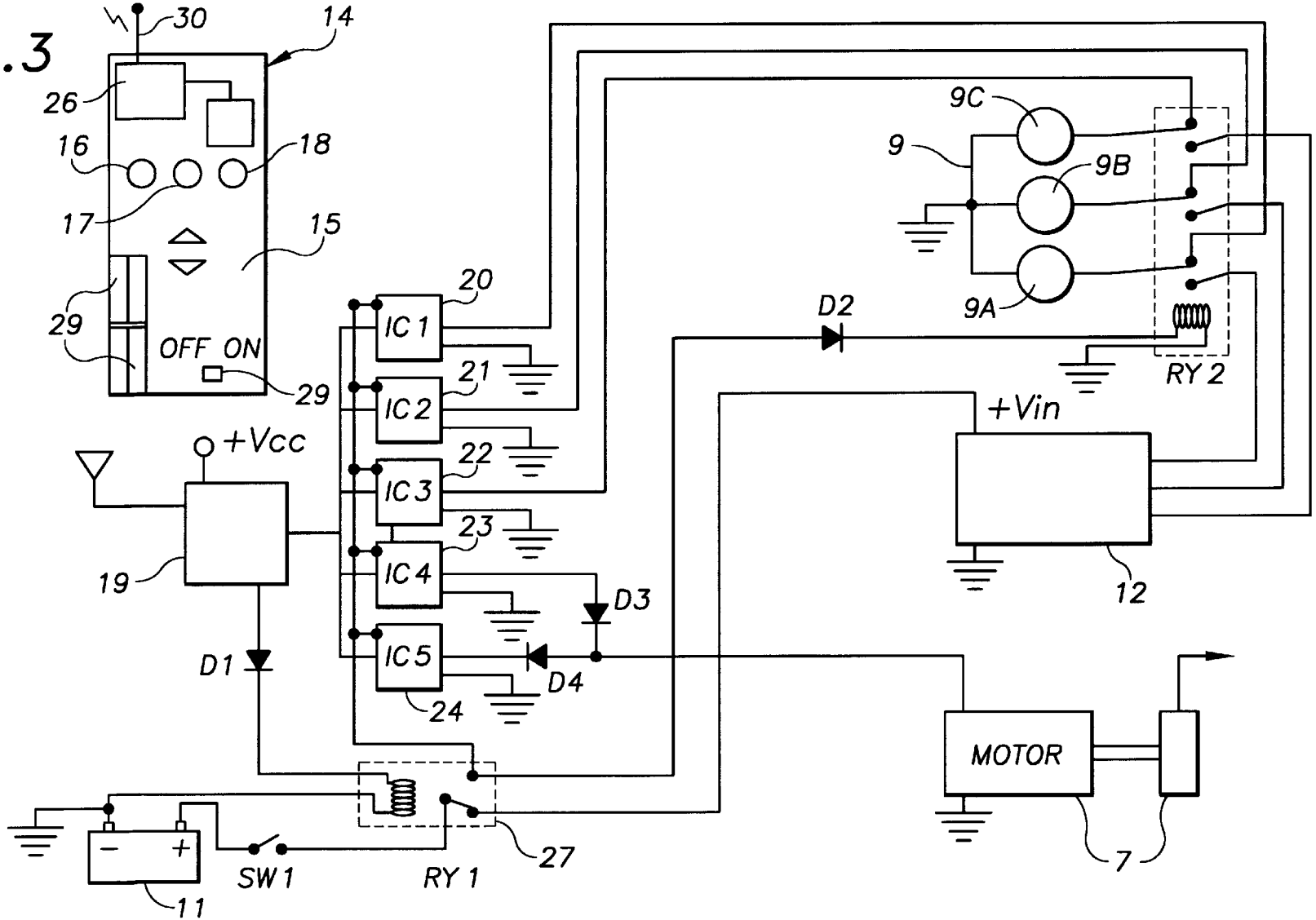
FIG. 3 depicts the internal remote control circuitry according to the present invention.
Figure 4:
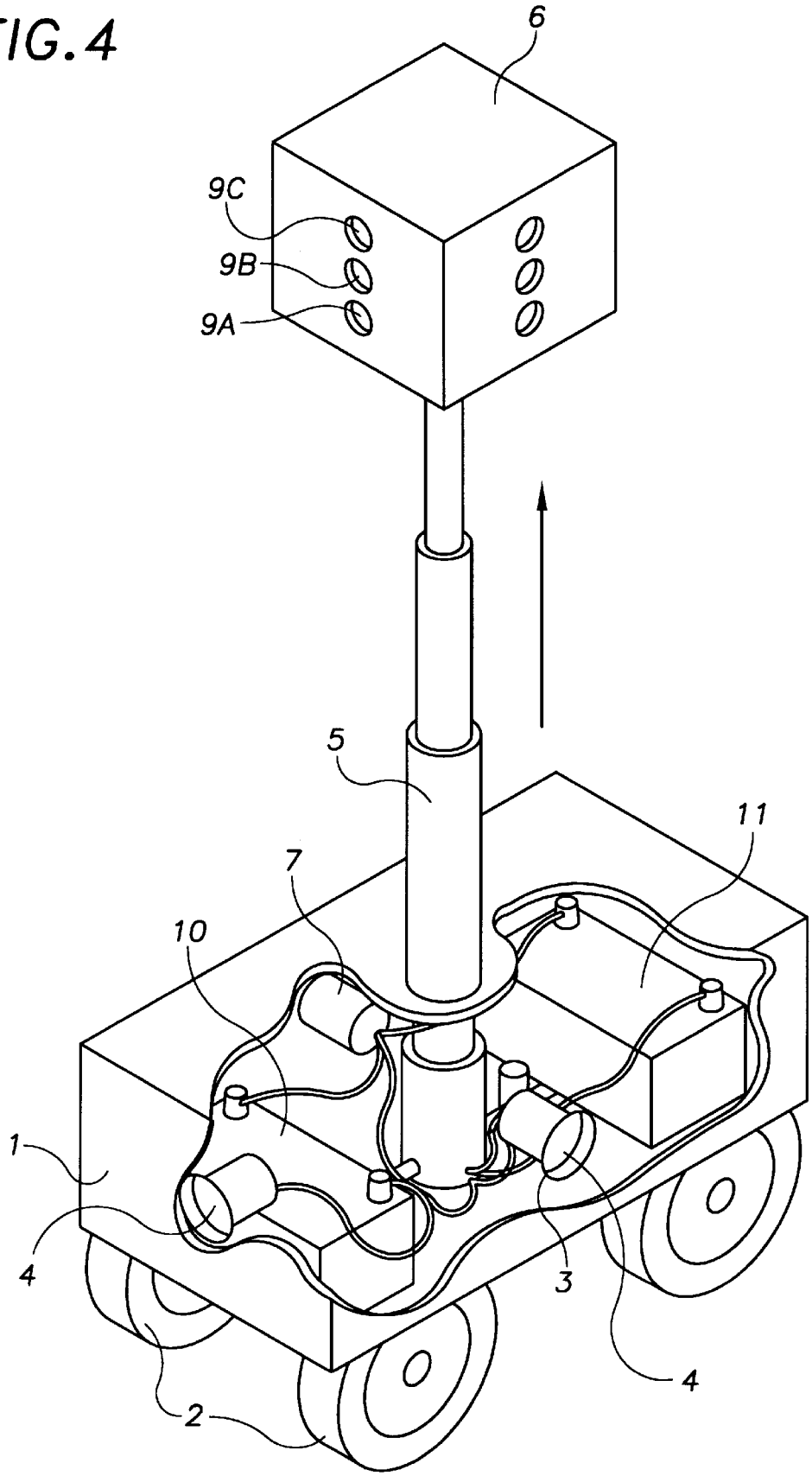
FIG. 4 depicts a partial cross-sectional view of the base component with the internal components depicted therein.

The portable traffic light assembly may also be manually controlled with a remote control means 14 allowing a user to control the device from a safe location distanced from oncoming traffic. Referring now to FIG. 3, a schematic of the circuitry for the remote control mechanism is depicted. A hand held remote control has a cover 15 with a standard radio frequency transmitter 26 received therein. A plurality of control buttons are disposed on the housing each corresponding to a select light, i.e., green 16, yellow 17 and red 18, to be illuminated. A radio frequency receiver 19 is located within the base component which is in communication with a plurality of integrated circuits each corresponding to a select light. Upon receiving a signal from the remote control means via the photoelectric sensors, the receiver causes a relay 27 to close delivering a signal to a select tone decoder integrated circuit 20, 21, 22 depending upon which light button on the control means is depressed. The green, yellow and red lights each have a preprogrammed, designated circuit, 20, 21, 22 respectively. Whenever a button on the control means cover corresponding to the desired light is depressed, a discrete square wave tone corresponding to the selected light is transmitted which will only activate the integrated circuit corresponding thereto.

A pair of additional integrated circuits 23, 24 each responding to a discrete frequency transmitted by the RF transmitter are also provided to activate the hydraulic lift pump. A first integrated circuit 23 relates to the lift mode for raising the telescoping arm by providing a positive voltage to the pump while the second integrated circuit 24 relates to lowering the telescoping arm by providing a negative voltage to the pump. Accordingly, each light means and the hydraulic pump may each be remotely operated using the remote control means. The remote control means is activated with a switch means 28 and further includes a battery means 29 for operating the transmitter and an antenna 30 for assisting the transmitter in delivering a signal to the receiver.

A single control scheme for activating a single set of lights on a housing side wall is depicted and described. However, a separate control scheme for selectively and separately controlling each set of lights may also be provided.

The telescoping support leg is preferably dimensioned to extend to thirteen feet or more. The various components of the present invention are preferably manufactured with anodized

What is claimed is:

1. A portable traffic light assembly comprising:

a hollow base component having upper and lower surfaces and a plurality of sidewalls, each sidewall having an aperture thereon with a photoelectric sensor adjacent thereto;

a plurality of roller means on the lower surface of said base component for transporting the device from one location to another;

a telescoping support leg extending from the upper surface of said base component, said leg movable between an extended and a retracted position;

a traffic signal unit secured to a distal end of said support leg, said unit including a box shaped housing having four side walls, each side wall having a plurality of discrete signal lights thereon for simultaneously signaling traffic flowing in various directions;

a lift means for automatically extending and retracting said support leg to position said traffic signal unit at a desired height, said lift means including a hydraulic pump received within said base component in mechanical communication with said telescoping support leg;

a remote control means for selectively activating each of said signal lights and said lift means from a remote location;

an automatic control means for automatically illuminating each of said lights for a predetermined duration;

a transmitter means for transmitting a signal to said sensors;

a receiver means received within said base component and in selective communication with said sensors, each of said signal lights and said lift means;

a first battery means for providing electricity to said lift means;

a second battery means for providing electricity to said signal lights;

a switch means for activating said remote control means.

* * * * *